US007220933B2

(12) United States Patent
Baiatu

(10) Patent No.: US 7,220,933 B2
(45) Date of Patent: May 22, 2007

(54) ARC QUENCHING DEVICE FOR CIRCUIT BREAKERS

(75) Inventor: Tudor Baiatu, Brugg (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 11/152,257

(22) Filed: Jun. 15, 2005

(65) Prior Publication Data

US 2006/0006145 A1 Jan. 12, 2006

(30) Foreign Application Priority Data

Jul. 8, 2004 (EP) ..... 04405431

(51) Int. Cl.
*H01H 33/20* (2006.01)

(52) U.S. Cl. ..... 218/34; 218/36; 218/149

(58) Field of Classification Search ..... 218/15, 218/22, 29–40, 148–157; 335/8–10, 16, 335/201, 202

See application file for complete search history.

(56) References Cited

U.S. PATENT DOCUMENTS

| | | | | |
|---|---|---|---|---|
| 4,849,590 | A * | 7/1989 | Becker et al. | 218/33 |
| 5,142,111 | A | 8/1992 | Blanchard et al. | |
| 5,495,083 | A | 2/1996 | Aymami-Pala et al. | |
| 5,777,286 | A | 7/1998 | Abot et al. | |
| 5,877,467 | A | 3/1999 | Arnold et al. | |
| 6,326,868 | B1 * | 12/2001 | Kranz et al. | 218/22 |
| 6,426,688 | B1 * | 7/2002 | DeVizzi et al. | 218/22 |
| 6,665,157 | B2 * | 12/2003 | Benard et al. | 361/13 |
| 6,952,149 | B2 * | 10/2005 | Ciarcia et al. | 335/16 |
| 2001/0021090 | A1 | 9/2001 | Benard et al. | |

FOREIGN PATENT DOCUMENTS

| | | |
|---|---|---|
| DE | 912 469 | 5/1954 |
| DE | 101 18 746 A1 | 11/2002 |
| EP | 0 350 825 A2 | 1/1990 |
| WO | 99/14776 | 3/1999 |

* cited by examiner

*Primary Examiner*—Elvin Enad
*Assistant Examiner*—M. Fishman
(74) *Attorney, Agent, or Firm*—Buchanan Ingersoll & Rooney PC

(57) ABSTRACT

The present invention specifies an arc quenching device having improved current limitation and reduced heat losses, in the case of which a moving contact piece (31) is not subject to increased erosion and wear. For this purpose, a quenching path according to the invention is provided which takes over an arc from said contact piece (31) and comprises arc guide rails (61), a quenching chamber (71) and a current-limiting element (8). Based on circuit breakers with double interruption, the current-limiting element (8) is preferably provided between arc guide rails (62, 52) of a second contact point and provided with a blowing section (81) for additional magnetic blowing of the arc of the first contact point.

9 Claims, 1 Drawing Sheet

ARC QUENCHING DEVICE FOR CIRCUIT BREAKERS

TECHNICAL FIELD

The present invention relates to the field of power breakers for low-voltage distribution networks. It relates to an arc quenching device for circuit breakers in accordance with the preamble of patent claim 1.

PRIOR ART

In low-voltage distribution networks, flush-mounted service switches are used for quick and reliable protection of cables, motors, apparatuses and systems to which low voltage is applied, against the consequences of overloading and short-circuit currents. They generally have a thermal release having a bimetallic strip and an electromagnetic release having a coil and an impact armature as well as preferably a contact arrangement with double interruption, i.e. having two series-connected contact points per pole with associated arc quenching chambers.

In the case of such switching devices, it is of critical importance for the life and switching performance for the arc produced when the contacts are opened not to remain on the contact pieces but to be guided as quickly as possible into a quenching chamber region where cooling and quenching of the arc take place. Each instance of the arc remaining on the contact pieces, even in the millisecond range, leads to increased erosion and wear of the contact pieces.

A normal circuit breaker has a contact point which is formed from a fixed and a moving contact piece. The contact point is located in a so-called prechamber which is adjoined by a quenching chamber having an arc splitter stack. The base points of the arc are guided away from the fixed and the moving contact piece to the arc splitter stack via arc guide rails. The arc itself in this case itself acts so as to limit the current. It expands immediately after opening of the contact point and the speed at which it flows into the arc splitter stack is then dependent on the so-called self-blowing, i.e. the magnetic blowing field produced by the arc itself, the pressure conditions in the arc, the shape of the guide rails and the selection of the contact material.

WO 99/14776 discloses a switching device having two series-connected contact points driven by a rotational movement. A permanent parallel contact path having a flexible conductor piece and an element which is in the form of a block and comprises a polymer PTC thermistor for improved current limitation is provided electrically in parallel with a first contact point. When the two contact points open, an arc is thus formed via the second contact point, whilst the current to be disconnected flows through the polymer PTC thermistor in parallel with the first contact point and is limited by said polymer PTC thermistor.

U.S. Pat. No. 5,877,467 discloses a circuit breaker having a single switching contact and a current-limiting quenching path. Said quenching path comprises an arc guide rail and a current-limiting element which is in the form of a block and comprises a polymer PTC thermistor which is screwed onto a connecting conductor leading to a connection terminal. In contrast to the previously mentioned case, this element does not carry current during rated operation, with the result that no undesired resistive loss is then produced. When the contacts are opened, an arc base point commutates from a fixed contact onto an arc guide rail, and the overcurrent triggering the switching action flows through the current-limiting element and is limited by it. In contrast to this, the opposite arc base point remains on the moving contact piece during the entire quenching operation.

SUMMARY OF THE INVENTION

The object of the present invention is to specify an arc quenching device having improved current limitation and reduced heat losses. In the case of which the moving contact piece is not subject to increased erosion and wear. This object is achieved by an arc quenching device for circuit breakers and a protective circuit as described herein. Further advantageous embodiments are described herein.

The essence of the invention is to provide and develop a quenching path having an arc guide rail and a current-limiting element on the side of the moving contact piece of a contact point such that an arc base point can easily change or commutate from the moving link contact to the arc guide rail.

A first embodiment of the arc quenching device according to the invention provides for a second arc guide rail which directly, i.e. without any DC-isolation point, adjoins the stationary contact piece of the contact point and guides the second base point of the arc to the arc quenching chamber.

In the case of a single contact, a second fixed contact is electrically conductively connected to the contact link via a moving conductor or a joint. In contrast to this, a contact arrangement with double interruption has a second contact point such that two arcs originate from two series-connected link contacts on the moving contact link. As soon as the arc of the first contact point or its link-side base point has changed over to the arc guide rail according to the invention, the short-circuited arc of the second contact point is quenched.

Such a configuration can be produced in a particularly simple manner by the arc quenching apparatus of the second contact point, i.e. at least the corresponding arc splitter stack, being replaced by the current-limiting element in a conventional circuit breaker with double interruption, whilst the quenching chamber of the first contact point remains unchanged. The second quenching chamber is thus short-circuited by a current-limiting conductor loop. There are thus no further adaptation requirements apart from the modification of the quenching chamber, with the result that the breaker which has been modified according to the invention can be produced in a cost-effective manner.

The current-limiting element is preferably formed by a dimensionally stable conductor loop which is shaped such that the current direction of the disconnection current to be limited is parallel to the current direction in the adjacent arc to be quenched, at least in a blowing section. As a result, a magnetic blowing effect is produced on the latter, i.e. the running properties of the arc in the opposite prechamber are affected favorably.

Since the quenching path during rated operation, i.e. when the switching contact is closed, does not carry any current, this does not influence the intrinsic impedance of the breaker and also does not impede commutation of the arc onto the corresponding arc guide rail as a result of its low initial or cold resistance of a few mΩ. Once commutation of the arc has taken place, the quenching path also has current flowing through it, as a result of which its impedance increases, limits the disconnection current and allows for simpler and more reliable quenching.

In order to further improve the disconnection capacity, a further conventional breaker having pure arc current limitation, for this purpose preferably with double interruption, can be provided in series with a modified breaker as described above. This circuit breaker combination shows considerably improved current limitation performance as compared with the current limitation performance of a conventional circuit breaker on its own, as a result of the additionally produced quenching voltage of the modified switching device.

BRIEF DESCRIPTION OF THE FIGURES

The invention will be explained in more detail below with reference to exemplary embodiments in conjunction with the drawing. Here.

Figure 1:
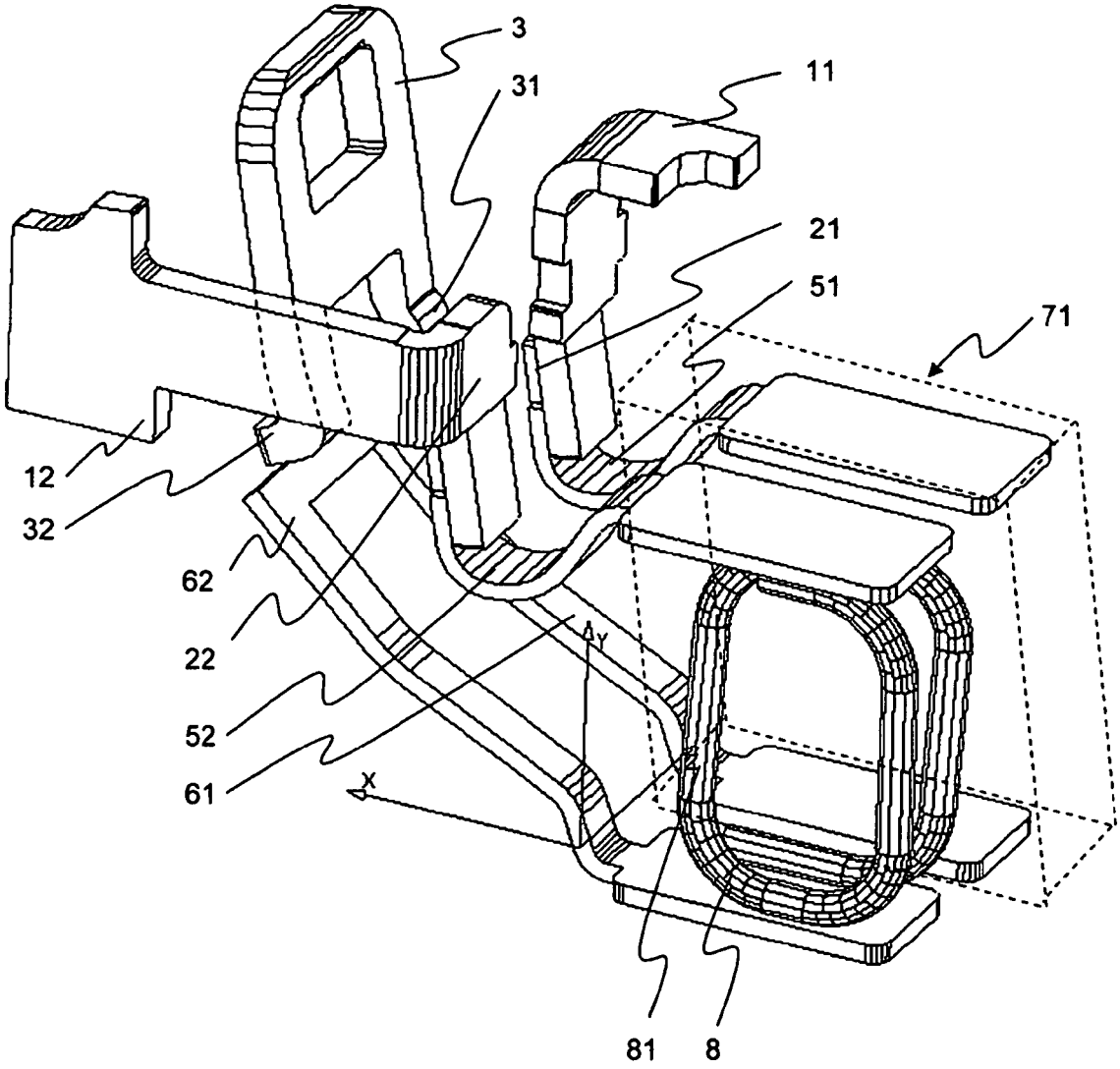
FIG. 1 shows an oblique plan view of one preferred embodiment of the quenching device according to the invention based on a circuit breaker with double interruption.

The reference symbols used in the drawing are summarized in the list of reference symbols.

APPROACHES FOR IMPLEMENTING THE INVENTION

FIG. 1 shows a detail of a single- or multipole circuit breaker having two series-connected switching contacts per pole. A first connection terminal leads to a first fixed contact 21 via the coil of a short-circuit current release (neither illustrated) and a first connecting conductor 11. Said fixed contact 21 is in electrical contact with a first link contact 31 of a moving fork-shaped contact link 3 in the closed position of the breaker (not illustrated). A second link contact 32 of the contact link 3 is in contact with a second fixed contact 22, which is then connected to an overcurrent release (not illustrated) and to a second connection terminal via a second connecting conductor 12, in the closed position of the breaker. The two contact points which are formed in each case by a fixed and a link contact are each associated with a first and a second prechamber, respectively.

When, in the event of a short circuit or an overcurrent through the short-circuit current release or the overcurrent release, the contact link 3 is moved away from the fixed contacts 21, 22, two arcs are formed between the fixed contacts 21, 22 and the link contacts 31, 32, said arcs having the disconnection current flowing through them in opposing directions. The link-side base point of the first arc will as a result commutate or "jump" from the link contact 31 onto the link-side arc guide rail 61. Owing to the shape of the link-side arc guide rail 61 (the "lower" one in the arrangement shown in FIG. 1) and the connection-side arc guide rail 51 (the "upper" one in the arrangement shown in FIG. 1) which is connected to the fixed contact 21, the first arc migrates between the first connection-side arc guide rail 51 and the first link-side arc guide rail 61 in the direction of a first arc quenching chamber 71 having arc splitter stacks (not illustrated), where it is split into arc elements and quenched.

The quenching device illustrated in FIG. 1 is based on a circuit breaker with double interruption. A second contact point is formed by a second link contact 32 and the second fixed contact 22 which are adjoined by a second link-side arc guide rail 62 and a second connection-side arc guide rail 52. While in the case of a conventional circuit breaker a second arc is passed to a second arc splitter stack at the end of the guide rails 52, 62, in the case of a switching device which has been modified according to the invention, the arc splitter plates are replaced by a current-limiting element 8.

In the preferred embodiment shown in FIG. 1, the current-limiting element 8 is in the form of a dimensionally stable conductor loop. A so-called blowing section 81 from this conductor loop comes to rest physically very close to the first prechamber and thus to the arc to be quenched. The identical current flow direction in the blowing section 81 and the arc ensures an additional magnetic blowing or sucking effect on the arc.

The current-limiting element 8 comprises a conductor having an electrical resistance which increases as the current increases, i.e., for example, metals having a positive linear or nonlinear thermal coefficient of specific resistance such as copper, iron, nickel, aluminum and alloys based on at least one of these metals, or the metallic alloys based on Ni, Co, Fe, which are known as PTC (positive temperature coefficient) thermistors, such as NiCr, NiMn, NiFe, NiCrMn, NiCo, NiCoFe, CoFe, CrAlFe, or else ceramic materials. A further such PTC thermistor is based on a polymer composite, whose polymer matrix is filled with a mixture of carbon, a metal such as Ni, and a boride, silicide, oxide or carbide such as $TiC_2$, $TiB_2$, $MoSi_2$, $V_2O_3$. In this case it is important that the initial or cold resistance is not too high and that commutation of the arc onto the link-side guide rail 61 and starting of the quenching path associated therewith are not impeded.

LIST OF REFERENCE SYMBOLS

11 First connecting conductor
12 Second connecting conductor
21 First fixed contact
22 Second fixed contact
3 Contact link
31 First link contact
32 Second link contact
51 First connection-side arc guide rail
61 First link-side arc guide rail
52 Second connection-side arc guide rail
62 Second link-side arc guide rail
71 Arc quenching chamber
8 Current-limiting element
81 Blowing section

The invention claimed is:

1. An arc quenching device for a circuit breaker, comprising:

a first and a second fixed contact which can each be connected to connection terminals of the circuit breaker;

a contact path, which carries current in a closed state of the breaker, between the fixed contacts, comprising a moving contact link having a first link contact which forms a first contact point with the first fixed contact;

a first link-side arc guide rail, through which no current flows in the closed state of the breaker, for the purpose of taking over an arc which forms when the first contact point is opened, and a quenching chamber for the purpose of quenching the arc; and a quenching path, through which no current flows in the closed state of the breaker, comprising the first link-side arc guide rail and a current-limiting element, wherein the quenching path is connected to the second fixed contact, and the first link-side arc guide rail is designed to take over a link-side arc base point from the first link contact.

2. The arc quenching device as claimed in claim 1, wherein a first connection-side arc guide rail is connected to the first fixed contact and is designed to take over a connection-side arc base point.

3. The arc quenching device as claimed in claim 1, wherein the second fixed contact forms, with a second link contact of the contact link, a second contact point of the circuit breaker with double interruption.

4. The arc quenching device as claimed in claim 3, wherein the quenching path comprises a second link-side arc guide rail and a second connection-side arc guide rail, and the current-limiting element is provided between the second link-side and second connection-side arc guide rails instead of an arc splitter stack.

5. The arc quenching device as claimed in claim 4, wherein the current-limiting element has a blowing section in which a disconnection current flows parallel to the arc current in the arc.

6. The arc quenching device as claimed in claim 1, wherein the current-limiting element comprises a copper-based resistor.

7. The arc quenching device as claimed in claim 1, wherein the current-limiting element comprises a PTC thermistor.

8. The arc quenching device as claimed in claim 1, wherein the current-limiting element is made of a ceramic material.

9. The arc quenching device as claimed in claim 1, wherein the current-limiting element is made of a polymer composite.

* * * * *